US009188391B2

(12) United States Patent
Li

(10) Patent No.: US 9,188,391 B2
(45) Date of Patent: Nov. 17, 2015

(54) VERTICAL/HORIZONTAL CONVERTIBLE SUSPENDING REDUCTION FURNACE

(71) Applicant: Hengjie Li, Shenzhen (CN)

(72) Inventor: Hengjie Li, Shenzhen (CN)

( * ) Notice: Subject to any disclaimer, the term of this patent is extended or adjusted under 35 U.S.C. 154(b) by 138 days.

(21) Appl. No.: 13/982,483

(22) PCT Filed: Oct. 14, 2012

(86) PCT No.: PCT/CN2012/082932

§ 371 (c)(1),
(2) Date: Sep. 5, 2013

(87) PCT Pub. No.: WO2013/060242

PCT Pub. Date: May 2, 2013

(65) Prior Publication Data

US 2013/0334743 A1 Dec. 19, 2013

(30) Foreign Application Priority Data

Oct. 28, 2011 (CN) ..... 2011 1 0335528

(51) Int. Cl.

| | |
|---|---|
| ***F27D 17/00*** | (2006.01) |
| ***F27B 17/00*** | (2006.01) |
| ***F27B 5/06*** | (2006.01) |
| ***F27D 99/00*** | (2010.01) |

(52) U.S. Cl.
CPC ..... *F27D 17/004* (2013.01); *F27B 5/06* (2013.01); *F27B 17/00* (2013.01); *F27D 99/0035* (2013.01)

(58) Field of Classification Search
CPC ..... F27D 17/004
USPC ..... 266/176
See application file for complete search history.

(56) References Cited

U.S. PATENT DOCUMENTS

2013/0334743 A1* 12/2013 Li ..... 266/176

* cited by examiner

*Primary Examiner* — Scott Kastler
(74) *Attorney, Agent, or Firm* — Michael D. Eisenberg

(57) ABSTRACT

A vertical/horizontal convertible suspending reduction furnace, comprises: a metal furnace body (5) of the reduction furnace, a reduction tank (13), a burner (2) and a suspension device. The metal furnace body (5) of the reduction furnace, which is connected with a sealing head (3) at one end, and connected with a fixed flange (20) of the reduction tank at the other end, is distributed with reduction tanks (13) inside uniformly. Burners (2) are provided symmetrically at the circumference of the metal furnace body (5), and a universal hoisting ring (4) is provided at its central point or off-central point. A steel rope (12), both ends of which are obliquely pulled on the suspension device, is hanged on the universal hoisting ring (4).

7 Claims, 14 Drawing Sheets

VERTICAL/HORIZONTAL CONVERTIBLE SUSPENDING REDUCTION FURNACE

FIELD OF THE INVENTION

The invention relates to a metal reduction furnace, mainly to a suspension-type automatic blanking vertical/horizontal convertible heat-storage energy-saving reduction furnace for refining and reducing a nonferrous metal.

BACKGROUND OF THE INVENTION

The traditional process of refining magnesium adopts the Pidgeon method. The method uses a horizontal furnace. The furnace body is laid on the base with a refractory brick. A plurality of reduction tanks are laid and distributed in the furnace. The reduction tank is filled with reactant pellets. Coal or oil is taken as fuel. A manual feeding and unloading method is adopted for combustion and heating. Firstly, the reduction tank is heated with radiant heat of a reverberatory furnace outside of the reduction tank; secondly, the heat is radiated and transmitted to the reactant pellets by the reduction tank; finally, the heat is transmitted by the reactant pellets through a mutual relay method. It is a peripheral heating.

It has been proved that: as to the combustion and heating method that the refractory brick is laid and forms a big hearth, as there are a big space in the hearth, big transmitting radius of heat radiation and a blind angle of high-temperature convection flue gas, there is bad temperature uniformity, and the reduction tank is easy to be overheated, generates thermal creep, is deformed and is scrapped. Furthermore, the feeds shall be manually loaded and unloaded during each reduction cycle, and the feeding and unloading feeds may not be mechanized and automated. Therefore, the old-fashioned furnace laid with the refractory brick has the disadvantages of high labor intensity, high energy consumption, low productivity, low reduction rate, and short service life of the reduction tank. The furnace body is laid with the refractory brick. It is generally maintained every about three months and carried out with big maintenance and replacement every about one year. Therefore, the service life of the furnace body is short.

SUMMARY OF THE INVENTION

The objective of the invention is to provide a suspension type automatic blanking vertical/horizontal convertible reduction furnace in which a furnace body of a steel housing is made of a steel structure. The furnace body of the steel structure adopts a suspension type structure integrally. The furnace part adopts a round metal furnace body made of steel, is provided with a plurality of independent reduction tanks inside, and may be burned horizontally and vertically through turnover. The heating part adopts a highly efficient burner, high-temperature flue-gas residual-heat recovery heating room-temperature combustion air and a burning heat-storage technique, thus changing the heating method of a big hearth of the bricked furnace body, greatly reducing the thermal radiation radius, facilitating the high-temperature flue gas to form a high-speed turbulent flow in the furnace body, facilitating the temperature in the furnace body to be uniform, achieving the objectives of fast heating, energy saving, high efficiency, environmental protection and small floor area, and preferably overcoming the deficiencies of the existing reduction furnace.

The technical proposal of the invention is as follows: the reduction furnace also comprises a metal furnace body of the reduction furnace, a reduction tank, a heat-storage burner and a suspension device, wherein the metal furnace body of the reduction furnace, which is connected with a sealing head at one end, and connected with a fixed flange of the reduction tank at the other end, is distributed with reduction tanks inside uniformly; a supporting flange of the reduction tank is also provided in the mental furnace body of the reduction furnace at one side of the sealing head; a fixed hole installed with the reduction tank is uniformly distributed on the fixed flange of the reduction tank; a positioning hole of the reduction tank is uniformly distributed on the supporting flange of the reduction tank; the positioning hole of the reduction tank corresponds to the fixed hole of the reduction tank; the upper end of the reduction tank is fixed in the fixed hole of the reduction tank; the lower end of the reduction tank is fixed in the positioning hole of the reduction tank; the upper end of the reduction tank is also provided with a cooling-off sleeve in which a cone-body crystallization sleeve is sealed and provided; the heat-storage burner is also symmetrically provided on the circumference of the metal furnace body of the reduction furnace; the provided directions of the heat-storage type burner are the same; a flame nozzle of the heat-storage type burner is provided in the metal furnace body of the reduction furnace; a universal hoisting ring is provided at the central point or off-central point of the reduction furnace; a steel rope, both ends of which are obliquely pulled on the suspension device, is hanged on the universal hoisting ring; close to the sealing head, a turnover hoisting ring is provided at the metal furnace body of the reduction furnace, and is connected with an electric hoister through a turnover steel rope; and by pulling and releasing the turnover steel rope, the metal furnace body of the reduction furnace overturns around the universal hoisting ring of the furnace body;

the reduction tank comprises a tank body, a cooling-off sleeve and a crystallization sleeve, wherein the end of a feeding port of the tank body is connected with the cooling-off sleeve; the cone crystallization sleeve is provided in the cooling-off sleeve; a cool water inlet, a cool water outlet and a vacuum port are provided respectively on the cooling-off sleeve; wherein the cool water inlet is connected with a water pump through a cool-water-entering distributor; the cool water outlet is connected with a water tank through a cool-water-outgoing collector; the vacuum port is connected with a vacuum pump through a vacuum distributor; and a port of the cooling-off sleeve is sealed and covered with an end cover.

the heat-storage type burner comprises a nozzle, wherein the nozzle is provided with an igniter, a fuel inlet, a hot flue-gas inlet and a hot flue-gas outlet, wherein the hot flue-gas inlet and the hot flue-gas outlet are respectively connected with a heat-transfer device of a heat storage body; and the suspension device comprises a portal frame; wherein the metal furnace body of the reduction furnace, the electric hoister, a walking mechanism and a feeding mechanism are suspended on the portal frame.

The technical proposal also comprises:

the heat-storage burner is provided along the same direction of the periphery tangent lines of the metal furnace body of the reduction furnace, thus facilitating the flame erupting out of the burner to be rotated and burned in the same direction.

two the heat-storage type burners are taken as one group, and the burner comprises a plurality of groups; two the heat-storage type burners A and B work alternately through a heat-storage body A, a reversal valve and a heat-storage body B, respectively; the heat-storage type burner A and the heat-storage type burner B are provided with the hot flue-gas inlet and the hot flue-gas outlet; The heat-storage body A and the heat-storage body B are provided with the hot flue-gas inlet and the hot flue-gas outlet respectively, wherein the hot flue-gas inlets A and the hot flue-gas outlets B of the heat-storage type burner A and heat-storage type burner B are respectively connected with the reversal valve through the hot flue-gas inlets and hot flue-gas outlets of the heat-storage body A and heat-storage body B.

the suspension device comprises a double-arch portal structure consisting of two portal structures; a suspension lifting ear is provided on the portal frame; the metal furnace body of the reduction furnace is suspended between two the portal frames; the suspension steel rope is pushed diagonally on the suspension lifting ear of the portal frame upwards; the walking mechanism is provided on the portal frame; the electric hoister is suspended on the walking mechanism; the electric hoister may be connected with the turnover hoisting ring on the metal furnace body of the reduction furnace through the rollover steel rope; the electric hoister may also be connected with the feeding mechanism; and when the turnover hoisting ring is pushed or loosed by the electric hoister through the rollover steel rope, the metal furnace body of the reduction furnace is rotated by 180 degree.

the walking mechanism is suspended on the portal frame; the walking mechanism comprises one an H-shaped steel; the H-shaped steel is sleeved with a U-shaped steel; a walking wheel is provided on the U-shaped steel; the walking wheel strides across a lower beam of the H-shaped steel; the lifting ear connected with the electric hoister is provided at the bottom of the U-shaped steel; and a lifting hook of the electric hoister is connected with the feeding mechanism through a steel rope of a hopper.

The feeding mechanism is provided with the hopper. the lower end of the hopper is provided with a discharge port; a bi-parting door is provided on the discharge port; two ends of the bi-parting type discharge door are hinged on the discharge port; the bi-parting ends of the bi-parting type discharge door are connected together through the steel rope of the discharge door; and the steel rope of the discharge door is connected with the electric hoister through the steel rope of the hopper.

A thermal insulation material layer is provided in the metal furnace body of the reduction furnace.

The invention has the following advantages: the reduction furnace is mechanized and intelligentized, controls key points of each condition through a PLC programming, and possesses a CRT display and surveillance monitoring. Compared with the traditional bricked construction furnace, one bricked reduction furnace needs more than one hundred tons of refractory materials. The consumable material of the metal furnace is one tenth as much as that of the old-fashioned bricked furnace. The old-fashioned bricked furnace has short service life and shall be maintained each 2-3 months averagely. Its overhaul period does not exceed one year. With the adoption of the invention, an insulating layer made of a fire insulation material is cast in the metal furnace body. The furnace body does not need replacement permanently. The insulation layer shall be only replaced each 2-3 years, thus realizing the mechanization of loading and unloading, reducing two thirds of labor, saving 60% of energy (oil, coal and gas), increasing by 2-3 times of the reduction cycle (compared with the original 12-hours reduction cycle) (about 4-6 hours reduction cycle), changing the large floor area, low thermal efficiency, low productivity, no automation, no mechanization, high labor intensity, harsh environment and other aspects of backwardness of the traditional bricked reduction furnace, and achieving mechanization, automation, energy saving, high production and easy maintenance effects of a process of extracting magnesium by a thermal method. The gas furnace adopts a metal furnace body, realizes industrial mass production and assembly, and completely changes the traditional bricked earth furnace structure.

In the figures: 1: Base; 2: Burner; 21: Igniter; 22: Fuel Inlet; 23: Hot Flue-Gas Inlet; 24: Hot Flue-Gas Outlet; 25: Burner Flange; 26: Flame Nozzle; 3: Sealing head; 31: Flange of Sealing head; 4: Swivel; 5: Metal Furnace Body of Reduction Furnace; 51: Upper Flange of Furnace Body of Reduction Furnace; 52: Roller Hanging Ring; 53: Lower Flange of Furnace Body of Reduction Furnace; 6: Portal Frame; 61: Suspension Lifting Ear; 7. Feeding mechanism; 71: Hopper; 72: Discharge Port; 73: Bi-Parting Type Discharge Door; 74: Steel rope of Discharge Door; 75: Hanging Ring; 8: Electric hoister; 81: Magnetic Valve; 82: Heat-Storage Body; 83: Blowing Engine; 84: Reversal Valve; 85: Draught Fan; 86: Flue-Gas-Discharge Pipe; 87: Heat-Storage Body B; 9: Walking Mechanism; 91: H-Shaped Steel; 92: Walking Wheel; 93: U-Shaped Steel; 94: Lower Beam; 95: Lifting Ear; 12: Suspension Steel rope; 13: Heat-Storage Type Reduction tank; 14: Vacuum Distributor; 15: Cool-Water-Entering Distributor; 16: Cool-Water-Outgoing Collector; 17: Rollover Steel rope; 18: Heat-Resistant Material Layer; 19: Cone Crystallization Sleeve; 20: Fixed flange of Reduction tank; 201: Fixed hole of Reduction tank; 30: Supporting Flange of Reduction tank; 301: Fixed hole of Reduction tank; 40: Cooling-off Sleeve; 41: Vacuum Orifice; 42: Cool Water Inlet; 43: Cool Water Outlet; 44: Upper Flange of Cooling-off Sleeve; 45:

Lower Flange of Cooling-off Sleeve; 50: Tank Body; 501: Flange of Tank Body; 502: Positioning Post of Tank Body; 60: End Cover; 601: Bolt Hole.

DETAILED DESCRIPTION OF THE EMBODIMENTS

With the combination of the drawings and embodiments, the invention is further described in the followings:

As shown in figures, the reduction furnace is in suspension type. The metal furnace body of the reduction furnace may be overturned. When a port of the reduction tank is upward, feeds may be mechanically loaded with the electric hoister. When the port of the reduction tank is downward, an end cover is removed. That is, the feeds may be unloaded with self weight. The reduction furnace may be not only horizontally burned but also vertically burned. The reduction furnace mainly consists of a metal furnace body of the reduction furnace, a reduction tank, a burner, a suspension device, a walking mechanism, a feeding mechanism and a heat-transfer device of a heat-storage body.

Figure 1:
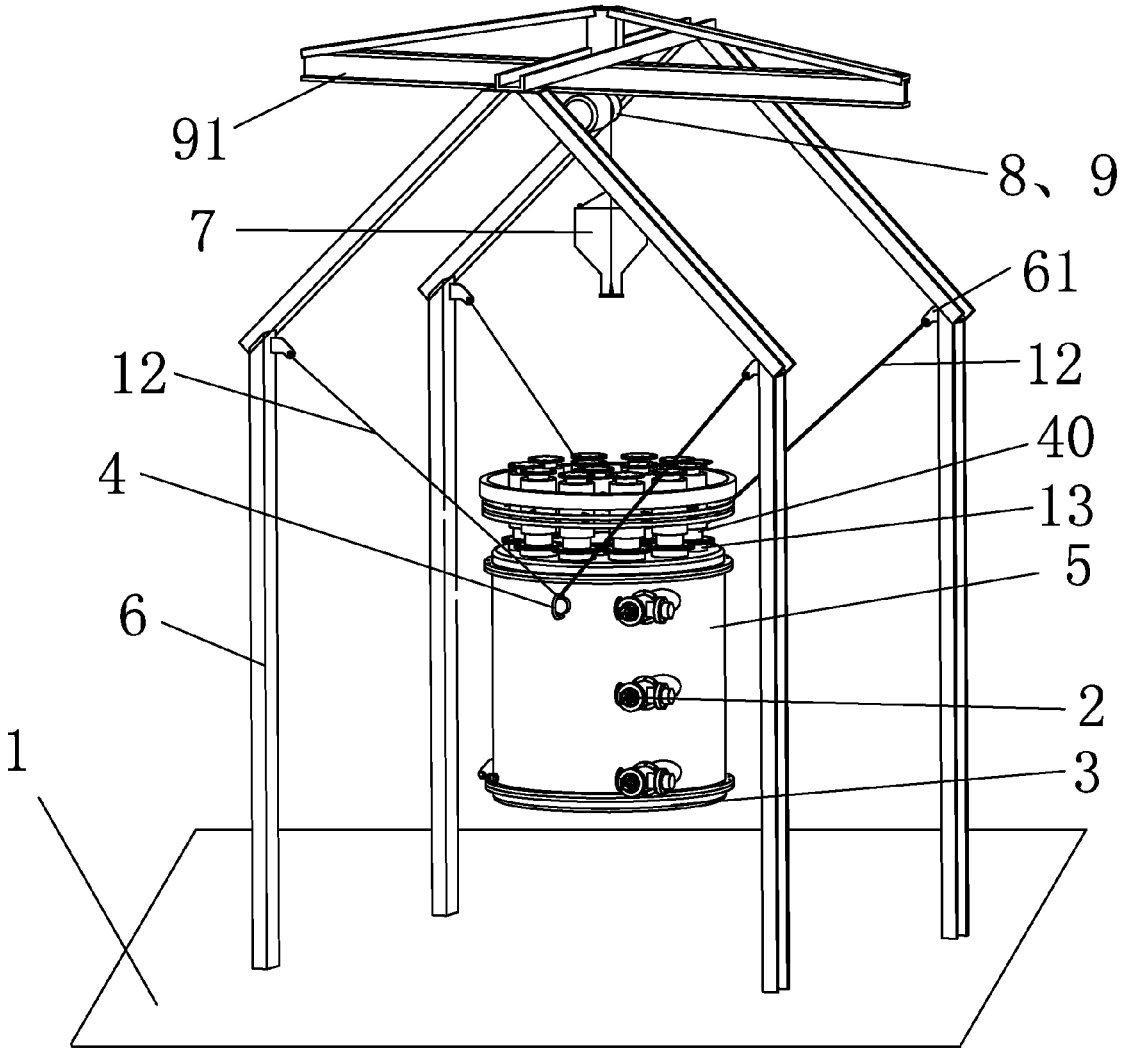
FIG. 1 is a 3-D schematic diagram of an overall structure of the invention.
Figure 2:
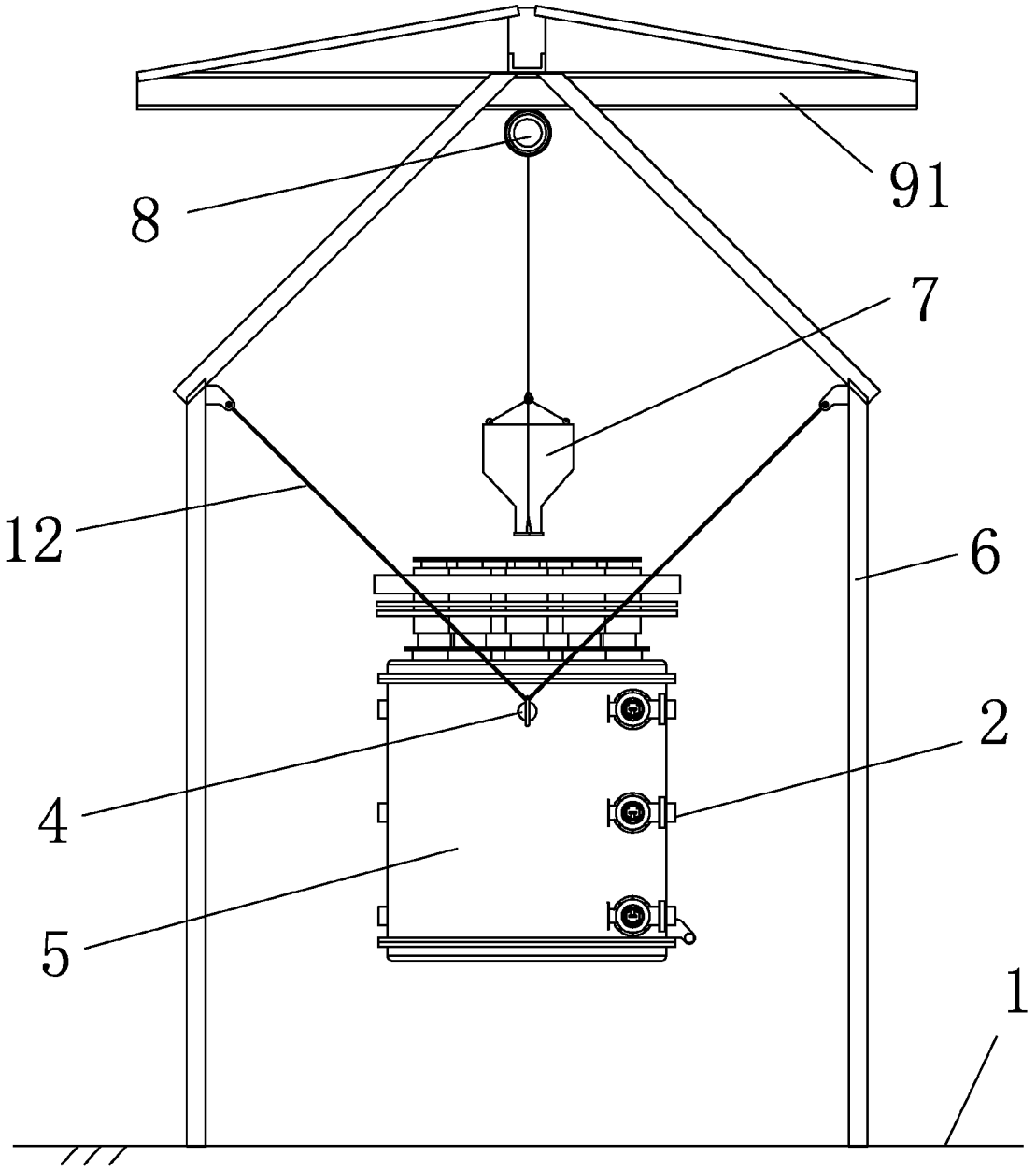
FIG. 2 is a vertical upward schematic diagram of a feeding port of a reduction tank of the invention.
Figure 3:
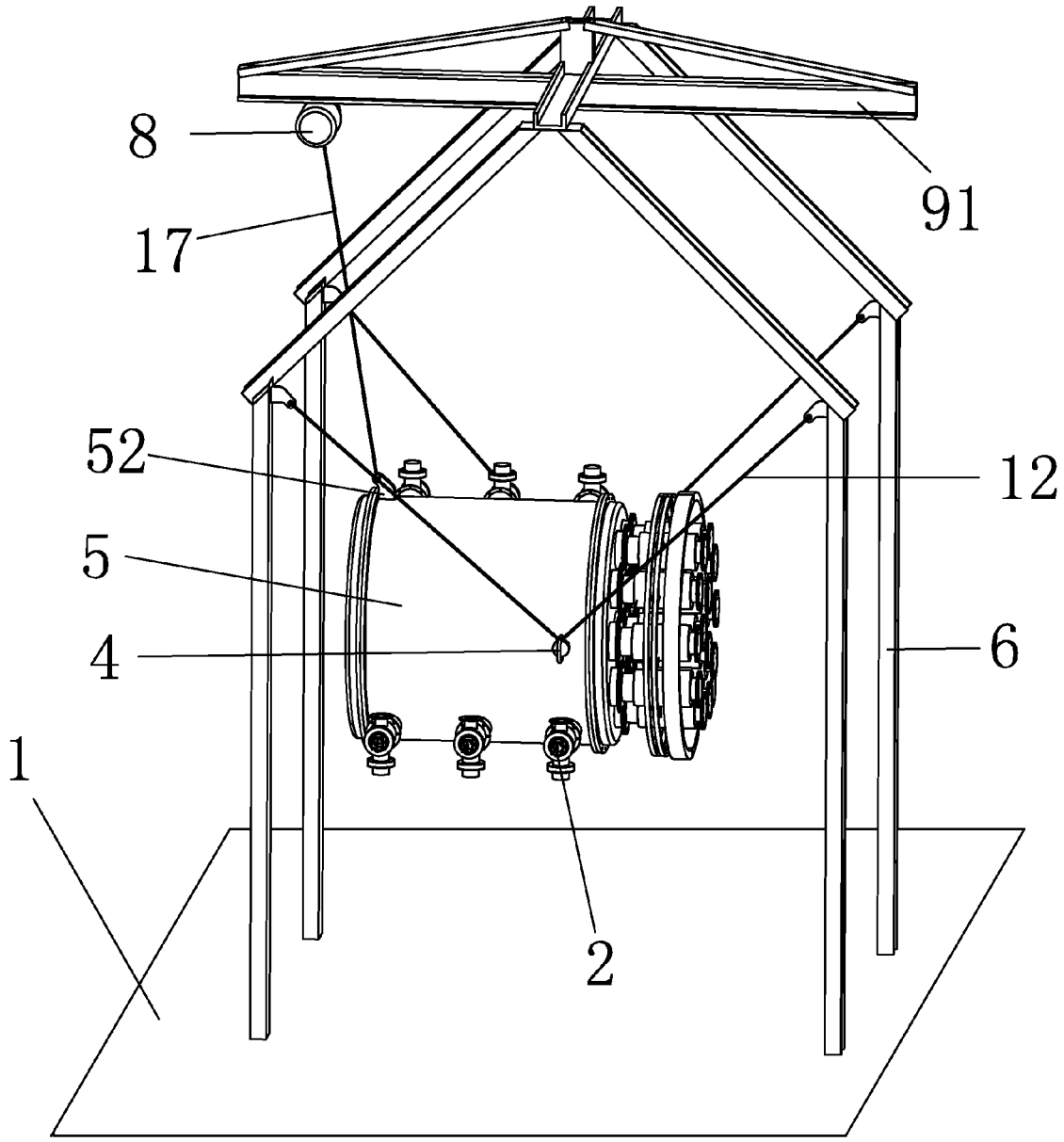
FIG. 3 is a horizontal 3-D schematic diagram of a reduction furnace of the invention.
Figure 4:
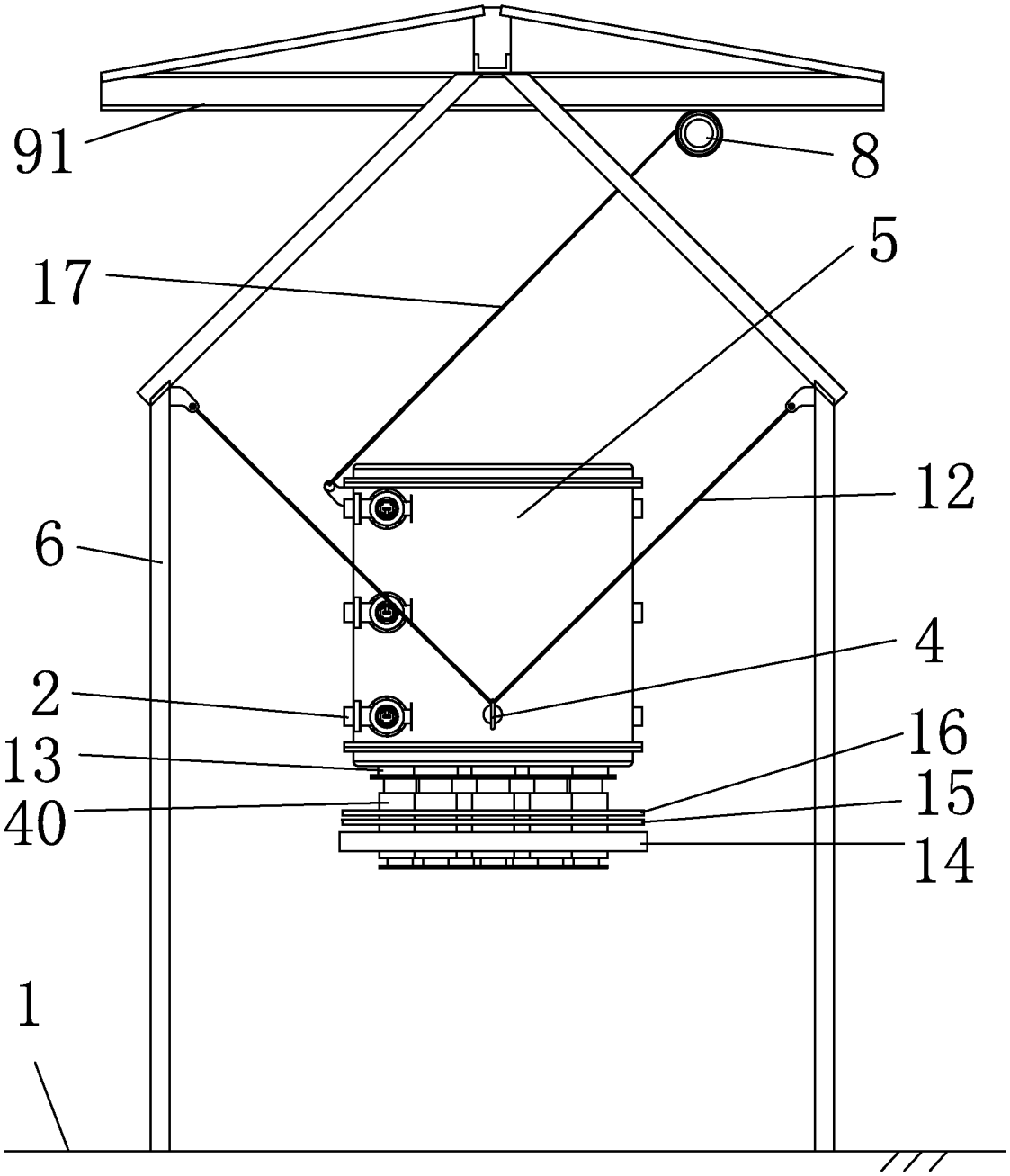
FIG. 4 is a vertical downward schematic diagram of a feeding port of a reduction tank of the invention.
Figure 5:
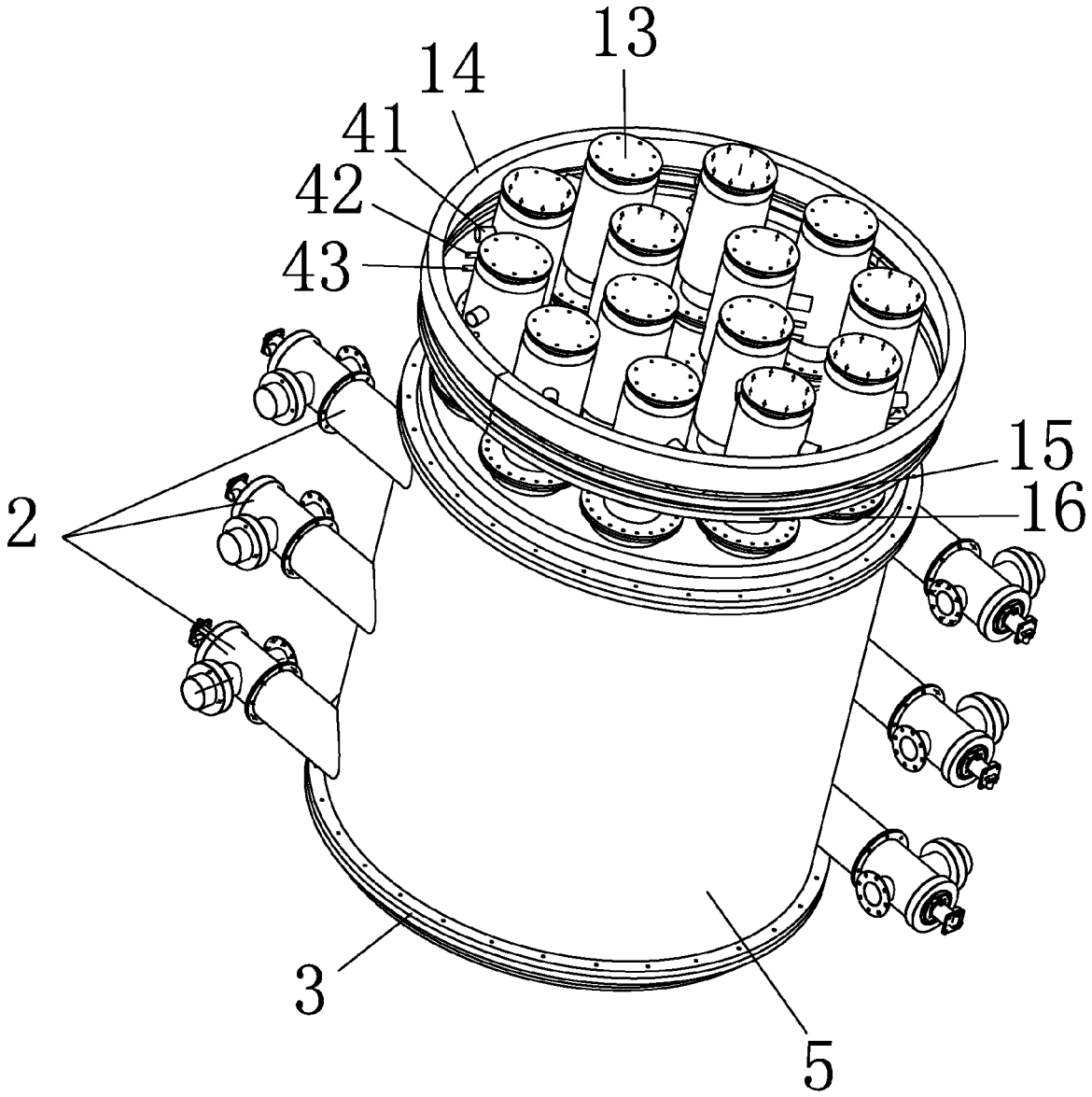
FIG. 5 is a 3-D schematic diagram of the assembly of a metal furnace body of a reduction furnace, a reduction tank and a burner of FIG. 1.
Figure 6:
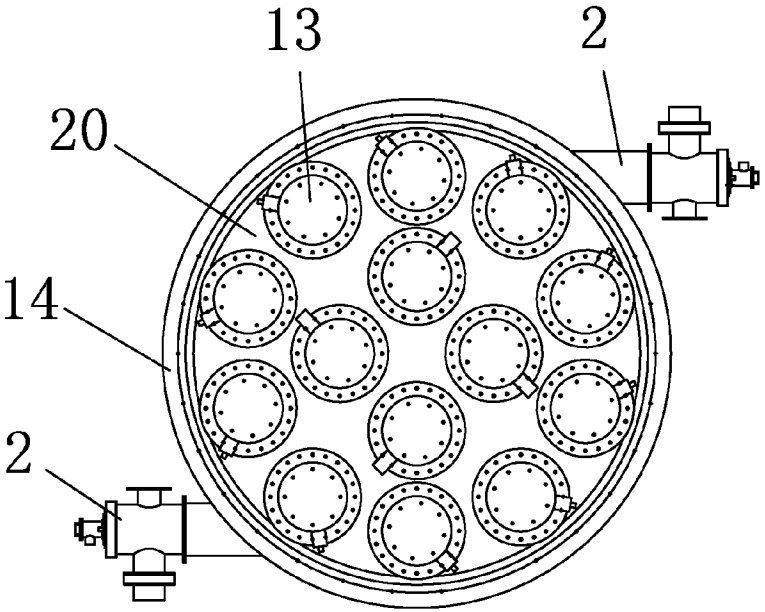
FIG. 6 is a top view of FIG. 5.
Figure 7:
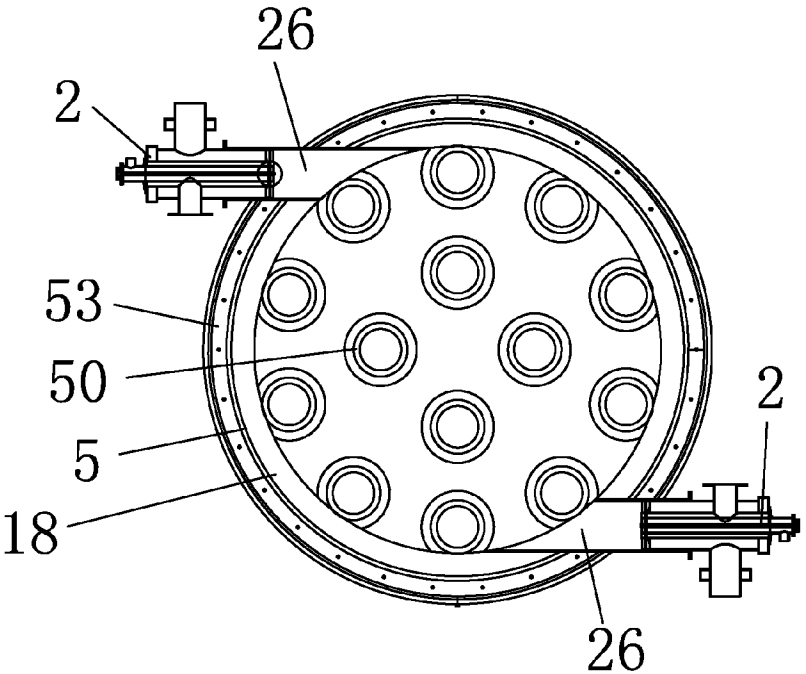
FIG. 7 is a cross sectional view of FIG. 5.
Figure 8:
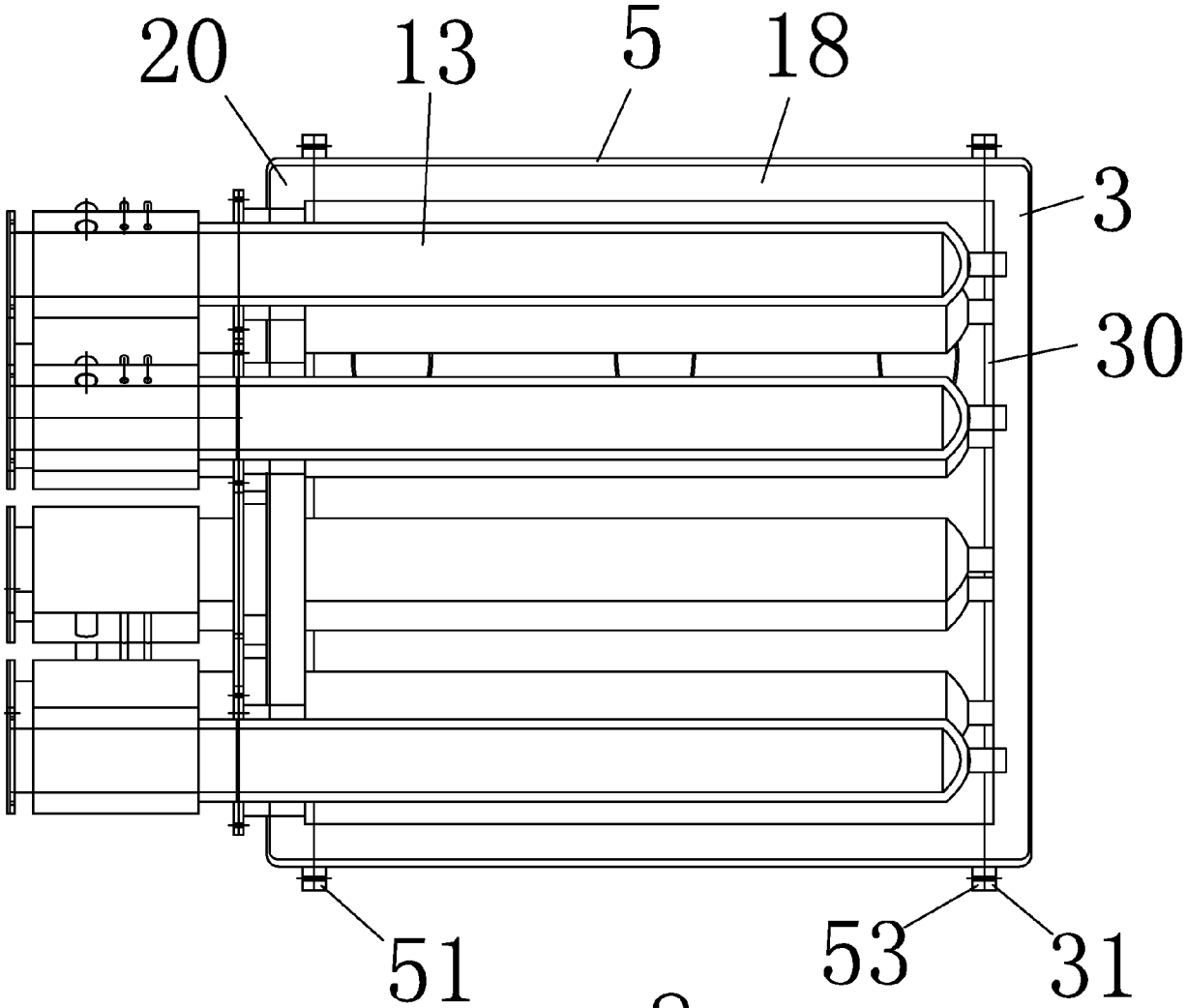
FIG. 8 is a cross sectional view of FIG. 5.
Figure 11:
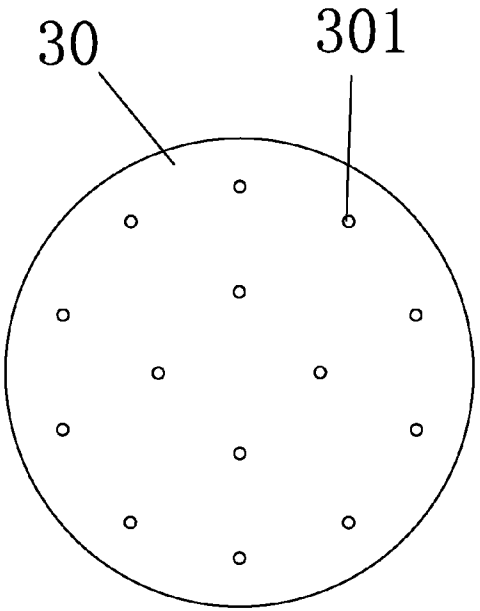
FIG. 11 is a schematic diagram of a supporting flange of a reduction tank of FIG. 5.
Figure 10:
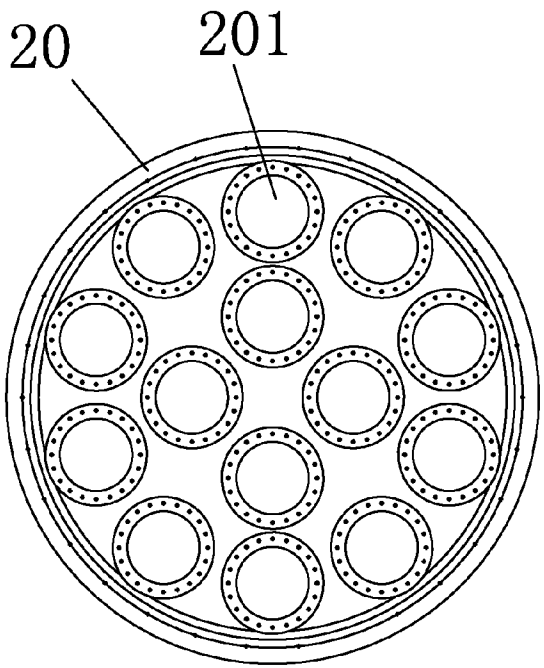
FIG. 10 is a schematic diagram of a fixed flange of a reduction tank of FIG. 5.
Figure 9:
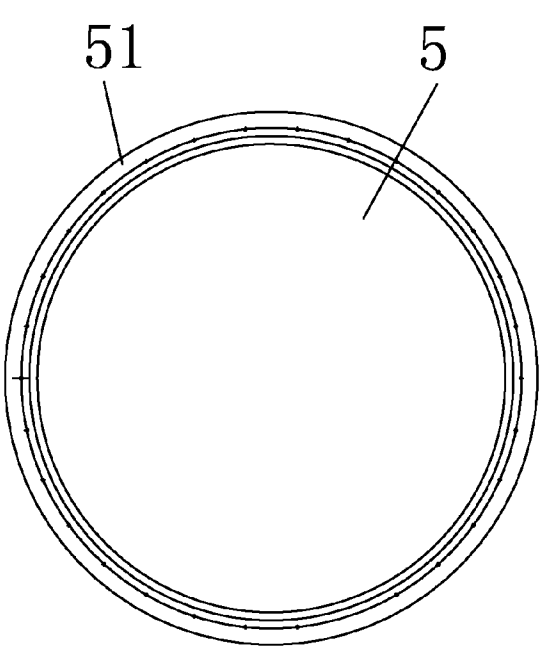
FIG. 9 is a schematic diagram of a metal furnace body of a reduction furnace of FIG. 1.
Figure 12:
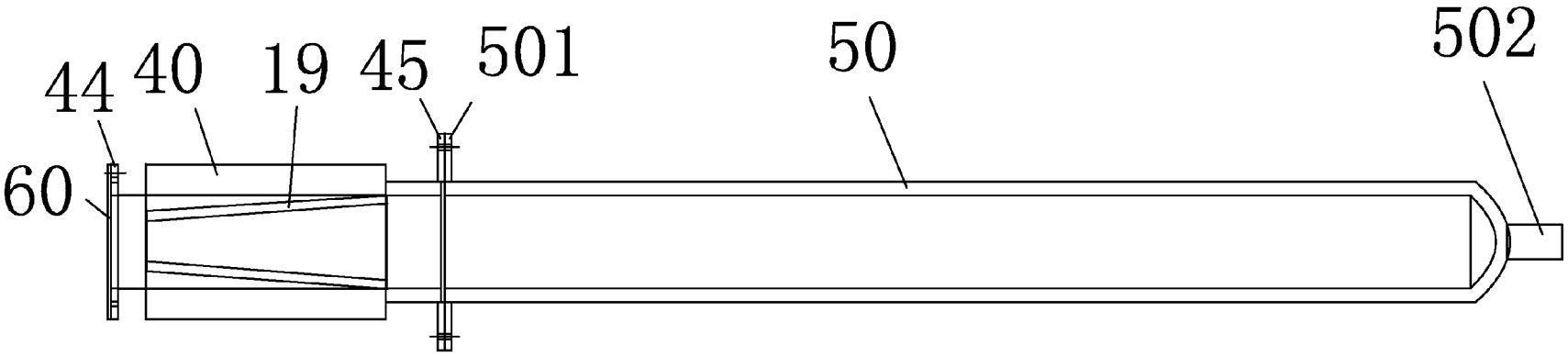
FIG. 12 is a schematic diagram of a reduction port of FIG. 5.
Figure 13:
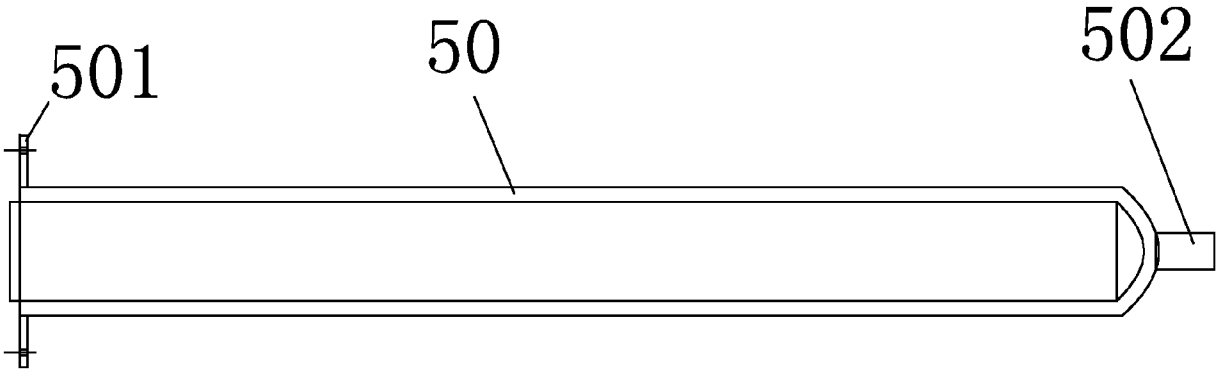
FIG. 13 is a schematic diagram of a port body of FIG. 12.
Figure 15:
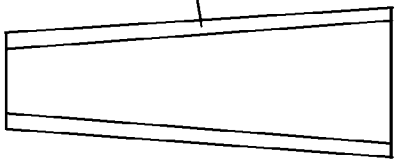
FIG. 15 is a schematic diagram of a cone crystallization sleeve of FIG. 12.
Figure 14:
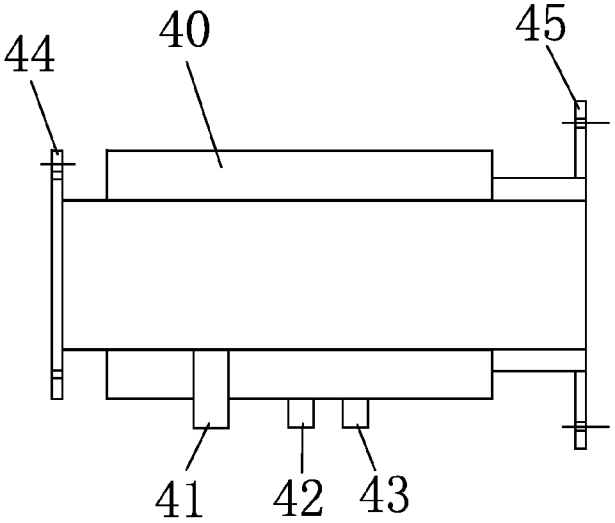
FIG. 14 is a schematic diagram of a cooling-off sleeve of FIG. 12.
Figure 16:
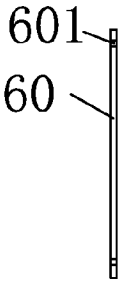
FIG. 16 is a schematic diagram of an end cover of FIG. 12.

As shown in FIGS. 1-4, the suspension device is mainly used for suspending the metal furnace body 5 of the reduction furnace. The walking mechanism 9 and the feeding mechanism 7 which are used for feeding feeds are provided on the suspension device. The suspension device consists of two portal structures and forms a double-arch portal structure. The portal frame 6 is fixed on the base 1. The suspension lifting ear 61 used for suspending the furnace body 5 of the reduction furnace is provided on the portal frame 6. FIGS. 1 and 2 show the state of vertically feeding feeds and combustion reduction. FIG. 3 shows the reduction state of horizontal combustion. FIG. 4 shows the state of reduction completion, an extracted crystallization sleeve and a poured-out waste residue.

As shown in FIGS. 5-8, the metal furnace body 5 of the reduction furnace, in which an insulation layer 18 is provided and two ends of which are provided with an upper flange 51 of the reduction furnace and a lower flange 53 thereof, is in cylinder shape. A supporting flange 30 of a reduction tank 13, used for supporting the reduction tank 13, is fixed in the furnace body of the reduction furnace 5, and is thereon distributed with a plurality of positioning holes 301 of the reduction tank. The front end of the metal furnace body 5 of the reduction furnace, through an upper flange 51 of the furnace body of the reduction furnace, is connected with a fixed flange 20 of the reduction tank, on which is distributed with a plurality of fixed holes 201 of the reduction tank. A plurality of the reduction tanks 13 (its number may be determined according to the requirement) is fixed in a hole 201 corresponding to a hole 301. The bottom of the reduction tank 13 is fixed in the hole 301. A plurality of burners 2 (its number may be determined according to requirements) is symmetrically provided on the circumference of the metal furnace body 5 of the reduction furnace, along its tangent line and in the clockwise direction. A flame nozzle 26 of the burner 2 is provided in the furnace body 5 of the reduction furnace. As the burners are provided along the tangent lines in the clockwise direction, the flame may be guaranteed to be rotated rapidly in the same direction and hence there are enough combustion, higher efficiency and more uniform heating. A universal hoisting ring 4 is provided at the central point or off-central point of the metal furnace body 5 of the reduction furnace. A steel rope 12, both ends of which are obliquely pulled on the suspension lifting ear 61 of a frame 62, is hanged on the universal hoisting ring 4. Close to the sealing head, a turnover hoisting ring 52 is provided on the surface of the metal furnace body 5 of the reduction furnace. One end of the turnover steel rope 17 is fixed on a turnover hoisting ring 52, and the other end thereof is connected with an electric hoister 8 on the waling mechanism. By pulling and releasing the turnover steel rope 17 and being moved on an H-shaped steel 91 at the same time, the electric hoister 8 may facilitate the furnace body 5 of the reduction furnace to be overturned by 180 degrees vertically, horizontally and vertically (as shown in FIGS. 1-4).

As shown in FIGS. 12-15, the reduction tank 13 consists of a tank body 50, a cooling-off sleeve 40 and a cone crystallization sleeve 19. The tank body 50 is provided with the flange 501 of the tank body at its front end, provided with a positioning post 502 of the tank body at its back end and loaded with feeds inside. The cooling-off sleeve 40 is provided with an upper flange 44 of the cooling-off sleeve at its front end and provided with a lower flange 45 of the cooling-off sleeve at its back end. The surface of the cooling-off sleeve 40 is also provided with a vacuum port 41, a cool water inlet 42 and a cool water outlet 43. The tank body 50 and the cooling-off sleeve 40 are connected through the lower flange 45 of the cooling-off sleeve and the flange 501 of the tank body. The cone crystallization sleeve 19 is loaded in the cooling-off sleeve 40. A gap is remained between the crystallization sleeve 19 and the cooling-off sleeve 40. The inner hole of the crystallization sleeve 19 is in cone shape (it is used for collecting crystal). The tank body 50 is fixed on the fixed hole 201 of the reduction tank of the fixed flange 20 through the flange 501 of the tank body. The positioning post 502 of the tank body is inserted into and fixed in the hole 301. the vacuum port 41 is connected with a vacuum pump through a vacuum distributor 14; the cool water inlet 42 is connected with a water pump through a cool-water-entering distributor 15; the cool water outlet 43 is connected with a water tank through a cool-water-outgoing collector; A connection hole is provided on a ring-shaped distributor and a water collector. The cool water inlet, the cool water outlet and the vacuum port are connected with the ring-shaped distributor and the water collector through a soft pipe. The flange 44 on the cooling-off sleeve of the cooling-off sleeve 40 is sealed and covered with an end cover 60.

Figure 17:
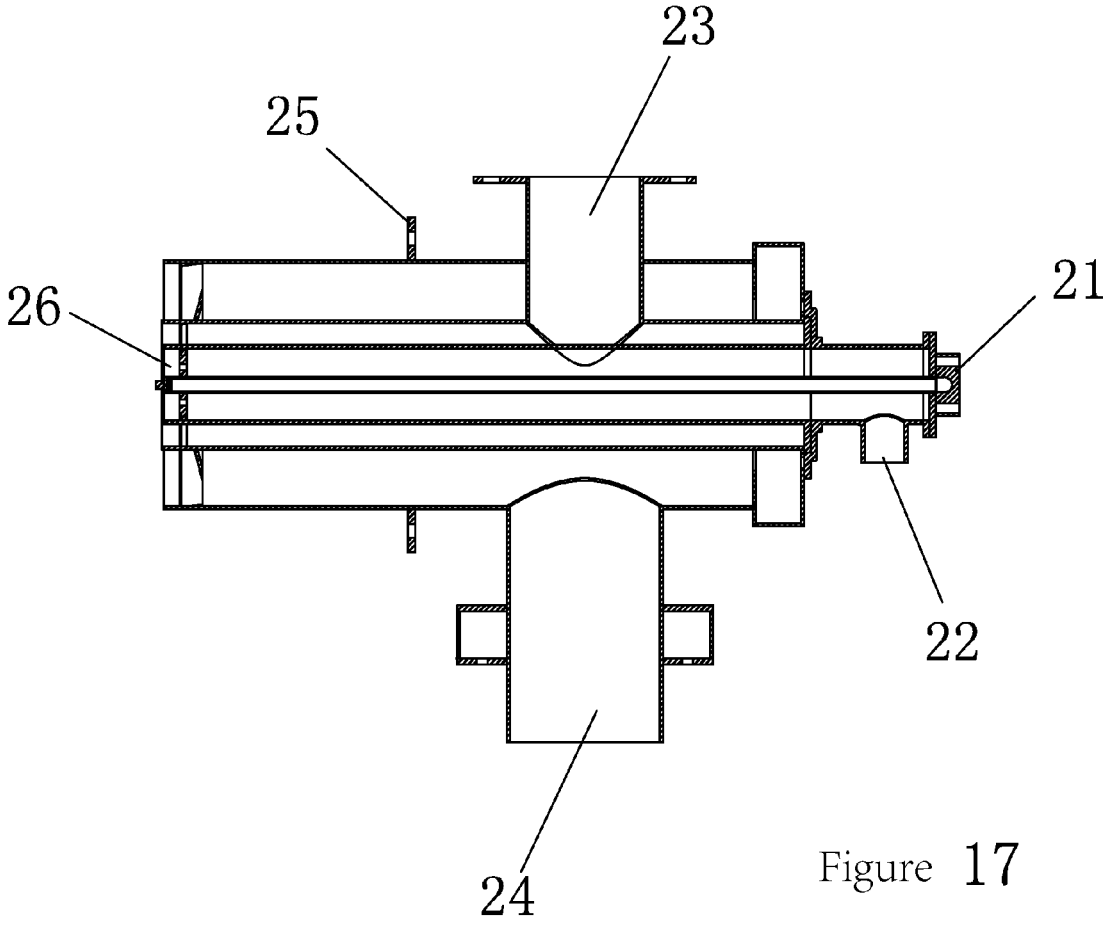
FIG. 17 is a schematic diagram of a burner of FIG. 5.

As shown in FIG. 17, the burner 2 consists of an igniter 21, a fuel inlet 22, a hot flue-gas inlet 23, a hot flue-gas outlet 24, a burner flange 25 and a flame nozzle 26. The burner 2 (its number is two times as large as 2, and it is divided into group A and group B) heats the reduction tank 13 in the tank body 50. The hot flue-gas inlet 43 and the hot flue-gas outlet 44 are respectively connected with the hot flue-gas inlet and hot flue-gas outlet of the heat-storage body 82 and heat-storage body 87.

Figure 20:
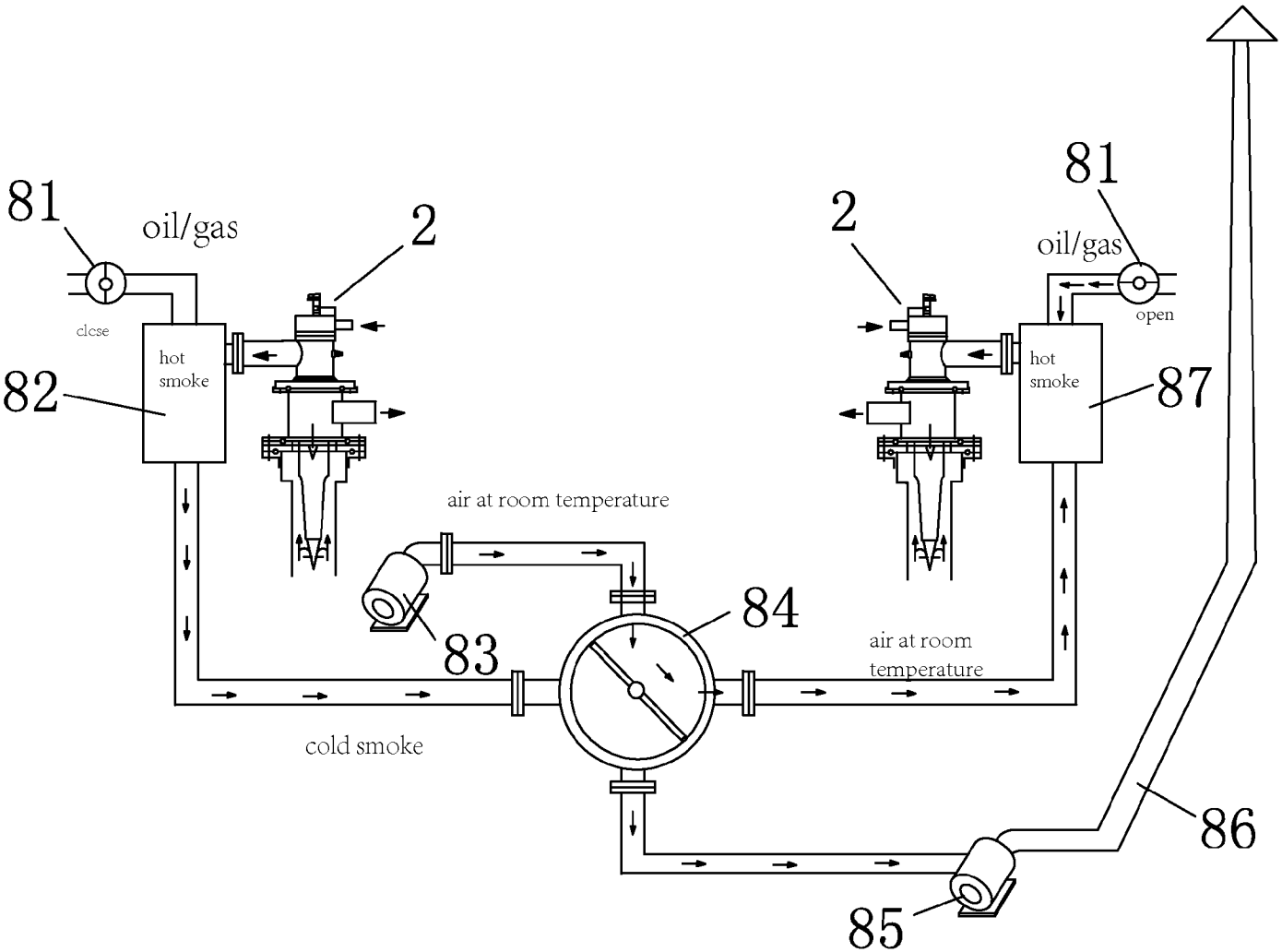
FIG. 20 is a schematic diagram of a heat-transfer device of a heat-storage body of the invention.

As shown in FIG. 20, the heat-transfer device of the heat-storage body consists of a magnetic valve 81, a heat-storage body A (82), a blowing engine 83, a reversal valve 84, a draught fan 85, a flue-gas-discharge pipe 86, and a heat-storage body B(87). The burners 2 are divided into two groups, wherein one group is connected with the heat-storage body A, and the other group is connected with the heat-storage body B. The hot flue gas produced in the furnace body 5 of the reduction furnace passes through the hot flue-gas outlet 44 and enters into the heat-storage body A and the heat-storage body B, respectively. With the action of the reversal valve 84, the hot flue gas again passes through the hot flue-gas inlet 43 and enters into the furnace body 5 of the reduction furnace, which are carried out alternately and play a role of combustion and energy saving.

Figure 18:
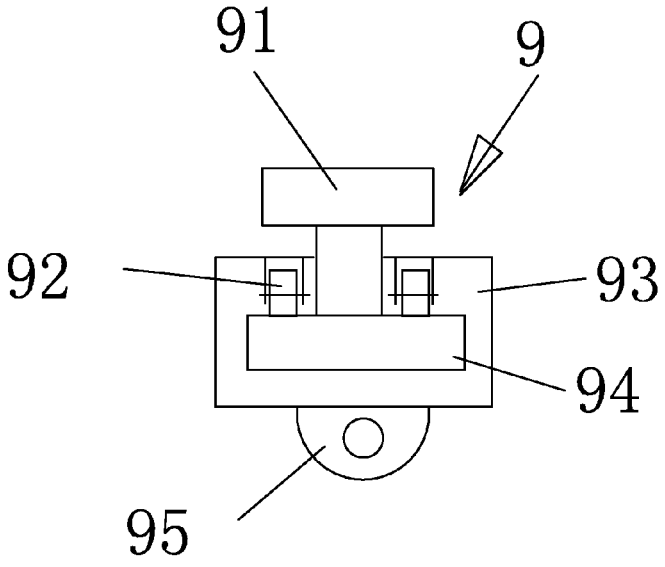
FIG. 18 is a schematic diagram of a walking mechanism of FIG. 1.

As shown in FIG. 18, the walking mechanism consists of a H-shaped steel 91, a walking wheel 92, a U-shaped steel 93, a lower beam 94, a lifting ear 95 and an electric hoister 8. The U-shaped steel 93, on which there are two walking wheels 92, is sleeved on the H-shaped steel 91. the walking wheel 92 strides across a lower beam 94 of the H-shaped steel 91; The U-shaped steel 93, on which the bottom is provided with the lifting ear 95 connected with the electric hoister 8, walks on the H-shaped steel 91. The electric hoister 8 is connected with a feeding mechanism 7 through a steel rope. When the electric hoister 8 is overturned, it also may be overturned by 180 degrees through the turnover steel rope 17, vertically, horizontally and vertically.

Figure 19:
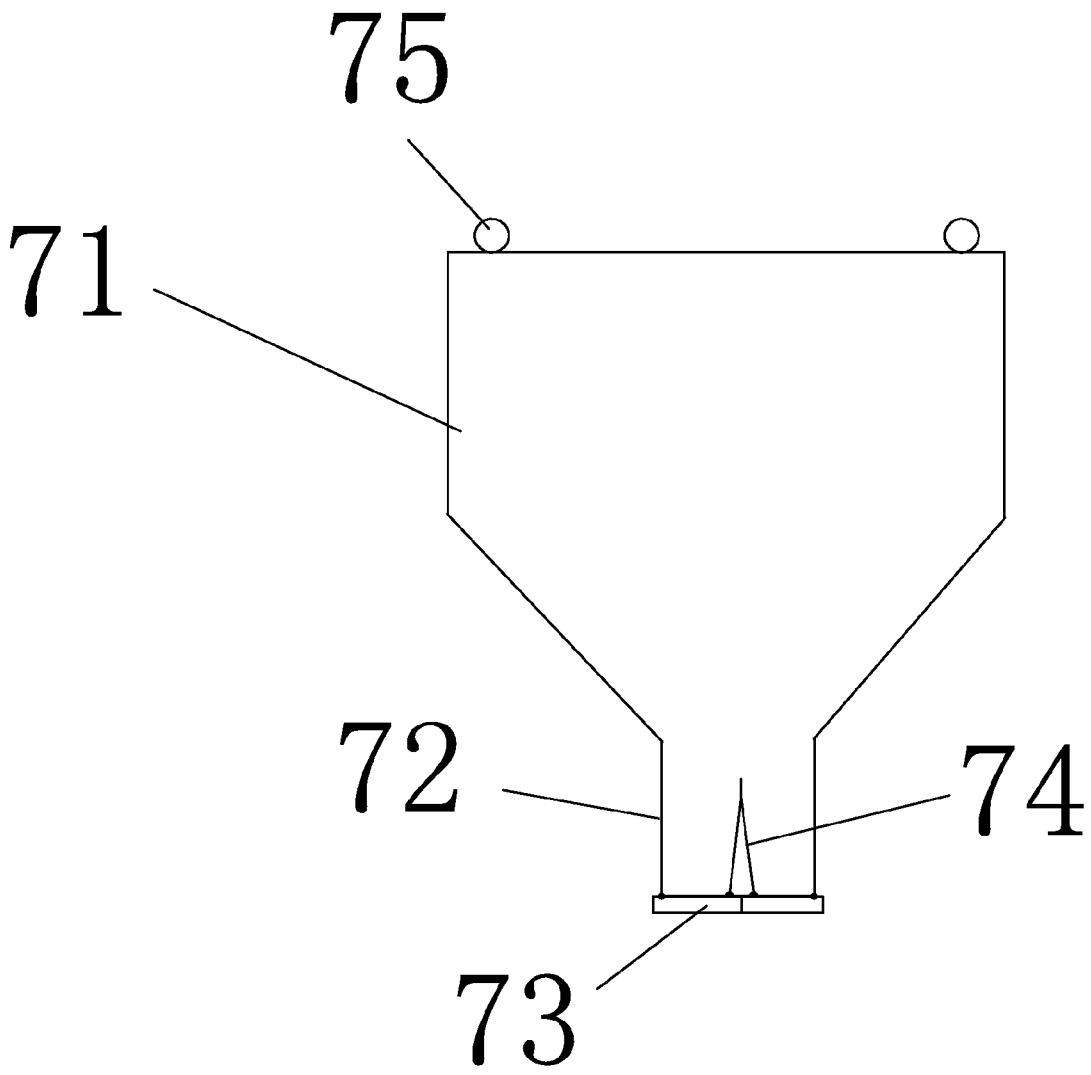
FIG. 19 is a schematic diagram of a feeding mechanism of FIG. 1.

As shown in FIG. 19, the feeding mechanism 7 consists of a hopper 71, a discharge port 72, a bi-parting type discharge door 73, a steel wire rope 74 of a discharge door and a hanging ring 75. The lower end of the hopper 71 is provided with a discharge port 72, on which the bi-parting type discharge door 73 is provided. Two ends of the bi-parting discharge door 73 are hinged on the discharge port 72, and the bi-parting ends of the bi-parting discharge door 73 are connected together through the steel rope 74 of the discharge door. The steel rope 74 of the discharge door is connected with the electric hoister 8 through the steel rope. When the steel rope is pulled up, the discharge door 93 is closed. When the steel rope is loosed, the discharge door 93 is automatically opened under the action of the gravity of the feeds, and the feeds flow into the tank body 50.

Figure 21:
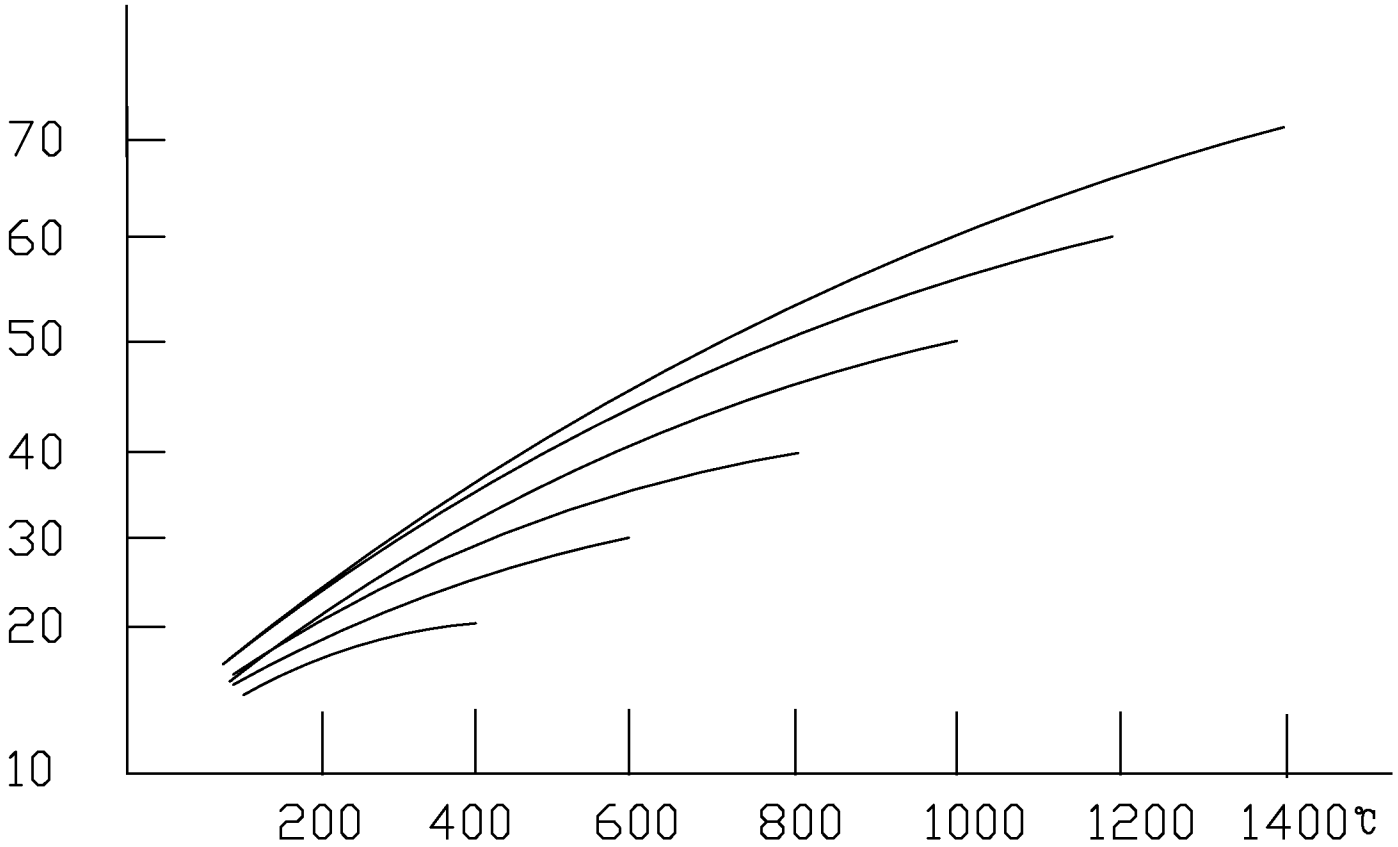
FIG. 21 is a curve diagram of a ratio relation of heat-storage preheating combustion air and fuel conservation of the invention.

As shown in FIG. 21, FIG. 21 is a curve diagram of a ratio relation of heat-storage preheating combustion air and fuel conservation of the invention, wherein the numbers 10-70 show the energy-saving ratio (%) of combustion; and the numbers 200-1400 show the temperature ( ) of heat-storage preheating combustion air. The curve in the figures shows the temperature curve of flue gas which is recycled and discharged without heat storage.

Working Principles:

The invention is adaptable for the requirements of constant temperature and heating within a heating temperature section required by each process under the temperature of 1200, magnesium produced by a thermal method, the heating, drying, thermally stimulating and thermally decomposing other metal material, atmospheric pressure or negative pressure adsorption type of 0.013/kpa according to the process requirements, and refining and thermal decomposition of non-ferrous metals and other adsorption type reduction process needing the negative pressure under the temperature of 1200. The furnace adopts a burner and a heat-storage heating type. The flame erupted from the burner rotates and burns in the furnace body, thus facilitating the feeds in the reduction tank to be heated and become hot rapidly. The feeds in the reduction tank are uniformly heated through highly efficiently and rationally using heat, convection and conduction to capacity.

As to the invention, a burner is directly provided on the metal furnace body, thus carrying out inside-out radiation, conduction, convection and heating. At the same time, auxiliary combustion with externally heating, heat storage, and the recycling, preheating and combustion air are provided, thus controlling and achieving high-temperature combustion with low excess air coefficient and hence achieving the best combustion heating effects.

The combustible gas or fuel oil, through a burner, is mixed in advance and injected into a furnace body to be burned. The high-temperature flue gas produced after combustion passes through the heat-storage body and enters the burner to be recycled and used. The combustible air and gas are pre-heated and heated from the room temperature to 800-1000. After the heat of the burned exhaust gas is exchanged in a heat-storage body, it becomes the flue gas under the temperature equal to or less than 150 and is discharged (the discharge and combustion temperature of the traditional old-fashioned furnace reaches 1000-1100). See FIG. 21: The Relation Table of Preheated Air Temperature and Combustion Saving Rate The furnace part of the furnace is divided into a separate structure consisting of a furnace body, a reduction tank and a sealing head. Such structure facilitates the reduction tank in the inner part to be installed and disassembled conveniently. When the reduction tank is replaced, the furnace body is laid down; the connection flange is loosed; the reduction tank is extracted to be replaced with a new one or maintained. Therefore, the furnace part is facilitated not to be scrapped and may be continuously used, thus prolonging the service life of equipment.

The working principle of the heat-storage type burner is as follows (as shown in FIG. 20): After the air under normal temperature discharged from a blowing engine is exchanged by a reversal valve and enters a heat-storage burner B, it is heated when it is passed through the heat-storage type burner B (a ceramic ball or a cellular body). In a very short period of time, the air under the normal temperature is heated to be under the temperature close to the furnace temperature (it is generally by 50~100 lower than the furnace temperature). After the heated high-temperature air enters the furnace, the flue gas in the furnace is entrained and forms a rarefied oxygen-poor high-temperature air with oxygen content which is significantly below 21%. At the same time, the fuel (oil or gas) is injected into the rarefied high-temperature air around. The fuel is burned under the lean oxygen (2-20%) state. At the same time, the burned hot flue gas in the furnace body passes through another heat-storage type burner A and is discharge into atmosphere. When the high-temperature flue gas in the furnace body passes through the heat-storage type burner A, the sensible heat is stored in the heat-storage type burner A and discharged through a reversal valve with the flue gas under the temperature of being lower than 150. The reversal valve under low working temperature is switched at certain frequency, facilitating two heat-storage burners to be under the working state that heat is alternately stored and discharged. Therefore, the objectives of energy saving and reduced Nox emissions are achieved. The commonly used switching period is from 30 to 200 seconds.

Working Processes:

The steel rope 17 is loosed, and the metal furnace body 5 of the reduction furnace becomes vertical under the action of gravity. At this time, the feeding port of the reduction tank 13 is upward. The discharge port 72 is facilitated to be aligned with the feeding port; the feeds are poured into a pipe body 50; a crystallization sleeve 19 is put into the pipe body 50 which is sealed and covered with an end cover 60, and then the ignition and heating start to be carried out. When the reduction is completed, the steel rope 17 is pulled, so that the furnace body 5 of the reduction furnace starts to be overturned downwards. When the furnace body 5 is under horizontal state or is downwards inclined, the end cover 60 is removed, and the crystallization sleeve is taken out and continues to be overturned by 180 degrees. At this time, the feeding port of the reduction tank 13 is downward. After the reduced waste residue is poured out and transported, the steel rope is loosed. Under the action of gravity, the metal furnace body 5 of the reduction furnace is vertical again. The second round feeding and heating are carried out again. This cycle continues. Also, the metal furnace body 5 of the original furnace is ignited and heated when it is under horizontal state.

As to the invention, the reduction tank may be fed through a lifting of a plant. The reduction furnace may be overturned through the lifting of the plant.

What is claimed is:

1. A suspension automatic blanking vertical/horizontal convertible heat-storage energy-saving reduction furnace, wherein the reduction furnace also comprises a metal furnace body of the reduction furnace, a reduction tank, a heat-storage type burner and a suspension device, wherein:

the metal furnace body of the reduction furnace, which is connected with a sealing head at one end, and connected with a fixed flange of the reduction tank at the other end, is distributed with reduction tanks inside uniformly;

a supporting flange of the reduction tank is also provided in the mental furnace body of the reduction furnace at one side of the sealing head;

a plurality of fixed holes installed with the reduction tank is uniformly distributed on the fixed flange of the reduction tank;

a plurality of positioning holes of the reduction tank is uniformly distributed on the supporting flange of the reduction tank;

a positioning hole of the reduction tank corresponds to the fixed hole of the reduction tank;

the upper end of the reduction tank is fixed in the fixed hole of the reduction tank;

the lower end of the reduction tank is fixed in a positioning hole of the reduction tank;

the upper end of the reduction tank is also provided with a cooling-off sleeve in which a cone-body crystallization sleeve is sealed and provided; the heat-storage burner is also symmetrically provided on the circumference of the metal furnace body of the reduction furnace; the provided directions of the heat-storage burner are the same; a flame nozzle of the heat-storage burner is provided in the metal furnace body of the reduction furnace; a universal hoisting ring is provided at the central point or off-central point of the reduction furnace; a steel rope, both ends of which are obliquely pulled on the suspension device, is hanged on the universal hoisting ring; close to the sealing head, a turnover hoisting ring is provided at the metal furnace body of the reduction furnace, and is connected with an electric hoister through a turnover steel rope; by pulling and releasing the turnover steel rope, the metal furnace body of the reduction furnace overturns around the universal hoisting ring of the furnace body;

the reduction tank comprises a tank body, a cooling-off sleeve and a crystallization sleeve, wherein a feeding port of the tank body is connected with the cooling-off sleeve in which the cone crystallization sleeve is provided; a cool water inlet, a cool water outlet and a vacuum port are provided respectively on the cooling-off sleeve; wherein the cool water inlet is connected with a water pump through a cool-water-entering distributor; the cool water outlet is connected with a water tank through a cool-water-outgoing collector; the vacuum port is connected with a vacuum pump through a vacuum distributor; and a port of the cooling-off sleeve is sealed and covered with an end cover;

the heat-storage burner comprises a nozzle, wherein the nozzle is provided with an igniter, a fuel inlet, a hot flue-gas inlet and a hot flue-gas outlet, wherein the hot flue-gas inlet and the hot flue-gas outlet are respectively connected with a heat-transfer device of a heat storage body; and the suspension device comprises a portal frame; wherein the metal furnace body of the reduction furnace, the electric hoister, a walking mechanism and a feeding mechanism are suspended on the portal frame.

2. The suspension automatic blanking vertical/horizontal convertible heat-storage energy-saving reduction furnace according to claim 1, wherein the heat-storage burner is provided along the same direction of the periphery tangent lines of the metal furnace body of the reduction furnace, thus facilitating the flame erupting out of the burner to be rotated and burned in the same direction.

3. The suspension automatic blanking vertical/horizontal convertible heat-storage energy-saving reduction furnace according to claim 1, wherein two of the heat-storage burners are taken as one group, and the burner comprises a plurality of groups; two heat-storage burners A and B work alternately through a heat-storage body A, a reversal valve and a heat-storage body B, respectively; the heat-storage burner A and the heat-storage burner B are provided with the hot flue-gas inlet and the hot flue-gas outlet; The heat-storage body A and the heat-storage body B are provided with the hot flue-gas inlet and the hot flue-gas outlet respectively, wherein the hot flue-gas inlets A and the hot flue-gas outlets B of the heat-storage burner A and heat-storage burner B are respectively connected with the reversal valve through the hot flue-gas inlets and hot flue-gas outlets of the heat-storage body A and heat-storage body B.

4. The suspension automatic blanking vertical/horizontal convertible heat-storage energy-saving reduction furnace according to claim 1, wherein the suspension device comprises a double-arch portal structure consisting of two portal structures; a suspension lifting ear is provided on the portal frame; the metal furnace body of the reduction furnace is suspended between two the portal frames; the suspension steel rope is pushed obliquely on the suspension lifting ear of the portal frame upwards; the walking mechanism is provided on the portal frame; the electric hoister is suspended on the walking mechanism; the electric hoister may be connected with the turnover hoisting ring on the metal furnace body of the reduction furnace through the rollover steel rope; the electric hoister may also be connected with the feeding mechanism; and when the turnover hoisting ring is pushed or loosed by the electric hoister through the rollover steel rope, the metal furnace body of the reduction furnace is overturned by 180 degrees.

5. The suspension automatic blanking vertical/horizontal convertible heat-storage energy-saving reduction furnace according to claim 1, wherein the walking mechanism is suspended on the portal frame; the walking mechanism comprises one an H-shaped steel; the H-shaped steel is sleeved with a U-shaped steel; a walking wheel is provided on the U-shaped steel; the walking wheel strides across a lower beam of the H-shaped steel; the lifting ear connected with the electric hoister is provided at the bottom of the U-shaped steel; and a lifting hook of the electric hoister is connected with the feeding mechanism through a steel rope of a hopper.

6. The suspension automatic blanking vertical/horizontal convertible heat-storage energy-saving reduction furnace according to claim 1, wherein the feeding mechanism is provided with the hopper; the lower end of the hopper is provided with a discharge port; a bi-parting discharge door is provided on the discharge port; two ends of the bi-parting discharge door are hinged on the discharge port; the bi-parting ends of the bi-parting discharge door are connected together through the steel rope of the discharge door; and the steel rope of the discharge door is connected with the electric hoister through the steel rope of the hopper.

7. The suspension automatic blanking vertical/horizontal convertible heat-storage energy-saving reduction furnace according to claim 1, wherein a thermal insulation material layer is provided in the metal furnace body of the reduction furnace.

* * * * *